United States Patent [19]

Liang et al.

[11] Patent Number: 4,596,378

[45] Date of Patent: Jun. 24, 1986

[54] HYDRAULIC FOUR-WHEEL JACK

[76] Inventors: Shu C. Liang, No. 23, Lane 77 Jen-Ai Rd.; Kuen S. Sheu; Ching B. Sheu, both of No. 3, Lin 4 Pei Hu Li, all of, Chia-Yi City; Kuen R. Tarng, No. 11, Chung-Ho Road, Chia-Yi Hsien, all of Taiwan

[21] Appl. No.: 793,232

[22] Filed: Oct. 18, 1985

Related U.S. Application Data

[63] Continuation-in-part of Ser. No. 617,259, Jun. 4, 1984, abandoned.

[51] Int. Cl.[4] ..... B66F 3/24

[52] U.S. Cl. ..... 254/8 B

[58] Field of Search ..... 254/8 B, 93 H, 93 R, 254/124, 10 B

[56] References Cited

U.S. PATENT DOCUMENTS

| | | | |
|---|---|---|---|
| 2,629,582 | 2/1953 | Stephenson et al. | 254/8 B |
| 3,967,814 | 7/1976 | Leibundgut | 254/8 B |
| 4,277,048 | 7/1981 | Okuda | 254/8 B |
| 4,359,205 | 11/1982 | Amster et al. | 254/8 B |

*Primary Examiner*—Robert C. Watson

[57] ABSTRACT

Structural improvements of a hydraulic four-wheel jack which protects the jack from damage resulting from overloading and/or overpumping, while offering a compact configuration having minimal space requirements. The jack incorporates a hydraulic unit assembly of the piston-and-cylinder variety in which the piston extends in an upwardly direction and bears against a cross-wise shaft being pivotably mounted between parallel cantilever arms, which carry on their respective free ends a lift assembly. The jack further incorporates a base having a unique series of interior passages provided with one-way, spring loaded ball-check-valves, whereby fluid communication is provided for the hydraulics of the jack.

3 Claims, 16 Drawing Figures

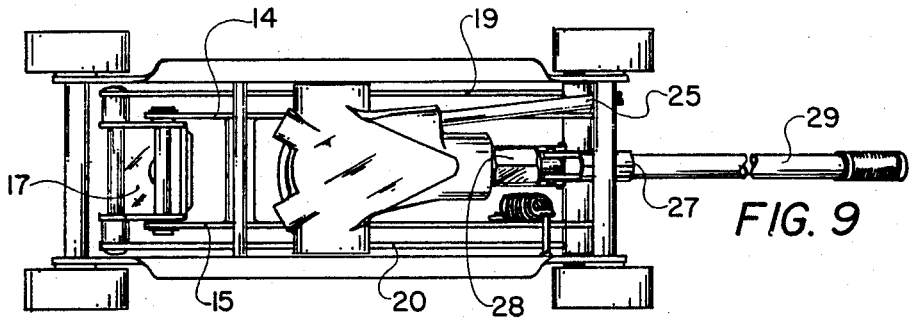
FIG. 9
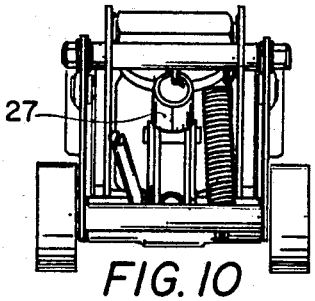
FIG. 10
FIG. 12
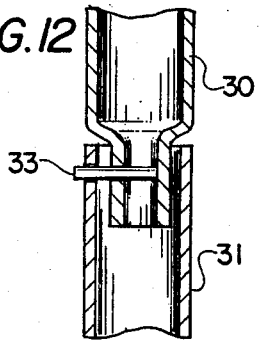
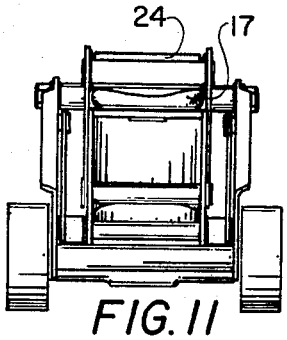
FIG. 11

HYDRAULIC FOUR-WHEEL JACK

CROSS REFERENCE TO RELATED APPLICATION

This application is a continuation-in-part of co-pending application, Ser. No. 617,259, filed June 4, 1984, now abandoned the disclosure of which is incorporated herein, in its entirety, by reference.

FIELD OF THE INVENTION

The present invention relates to structural improvements to hydraulic jacks and, in particular, to structural improvements to hydraulic four-wheel jacks.

BACKGROUND OF THE INVENTION

Hydraulic jacks comprise usually three types: The vertical type, the four-wheel type and the large type, respectively. The four-wheel types are normally designed to be carried within a vehicle for use at home or on the road wherever and whenever needed. At the present time, these type of four-wheel jacks have several disadvantages in that they are relatively bulky and expensive.

Accordingly, there remains a need to provide a four-wheel jack which requires less storage space, is less bulky and is less expensive than present four-wheel jacks, and is easier and more convenient to use.

SUMMARY OF THE INVENTION

Accordingly, it is an object of the present invention to alleviate the deficiencies of the prior art by producing an improved four-wheel jack which achieves the following advantages: (1) it reduces the storage space by about one-third, thereby facilitating storage in the trunk of a sedan or other light-weight vehicle; (2) it reduces fabrication and transportation costs; and (3) it reduces the bulk and weight, thereby facilitating easier operation and handling.

It is another object of the present invention to provide a four-wheel jack which, by changing the position of the application of force prevailing in conventional devices and utilizing a different execution of the principles of levers permits the introduction of a relatively smaller pump piston as compared with that of the prior art devices.

It is yet another object of this invention to provide a four-wheel jack, of the piston-and-cylinder variety, which has an improved hydraulic system that protects the jack from damage resulting from overloading and/or overpumping.

In accordance with the teachings of the present invention, a hydraulically operated lifting device is provided of the type having a four-wheeled carriage which includes a pair of substantially parallel side plates. A pair of elongated cantilever arms extend above the side plates and each has a pair of end portions. Means are provided for pivotably mounting one end portion of each of the arms between the side plates (near one end of the carriage) and a lift assembly is provided on the other free end of each of the arms. A pair of elongated stabilizing struts are parallel with the cantilever arms and are pivotably connected between the side plates and the lift assembly. Within this structure, the improvement of the present invention includes a hydraulic cylinder pivotably mounted between the side plates intermediate the ends thereof. A piston is disposed within the cylinder and is operatively associated therewith. A shaft, which is substantially rectangular in cross-section and has a plurality of flat faces, is pivotably mounted crosswise on the cantilever arms intermediate the end portions thereof. The piston extends in a substantially upwards direction and engages one of the flat faces on the shaft thereby raising the cantilever arms, struts and lift assembly.

In accordance with the further teachings of the present invention, a hydraulically operated lifting device is provided, having a first extended position and a second collapsed position. This jack has a four wheeled carriage and includes a pair of substantially parallel side plates. A pair of parallel elongated cantilever arms extend above the side plates, and each has a pair of end portions. Means are provided for pivotally mounting one end portion of each of the arms between the side plates (near one end of the carriage), and a lift assembly is provided on the other free end of each of the arms. A pair of elongated stabilizing struts are parallel with the cantilever arms and are pivotably connected between the side plates and the lift assembly. Within this structure, the improvement includes a hydraulic actuator, having an outer annular oil supply reservoir and an inner cylinder, pivotably mounted between the side plates intermediate the end of the carriage. A piston is disposed within the inner cylinder and is operatively associated therewith. A shaft, substantially rectangular in cross-section and having a plurality of flat faces, is pivotably mounted cross-wise on the cantilever arms intermediate the end portions thereof, whereby the piston extends in a substantially upwardly direction engaging one of the flat faces on the shaft. Hydraulic fluid is disposed in the outer reservoir. A reciprocating pump means is provided for pumping hydraulic fluid from the outer reservoir and into the inner cylinder. A pressure release valve having a first closed position, whereby oil pressure in the inner cylinder is maintained, and a second open position, whereby hydraulic fluid is allowed to flow from the inner cylinder, is provided. A base is disposed beneath the hydraulic cylinder, and secured thereto. The base has at least one first interior passage positioned between, and in fluid communication with, the outer reservoir, the reciprocating pump means and the inner cylinder. At least two (2) one-way, spring-loaded ball-check-valves are disposed in the first interior passage. The base also has at least one, second interior passage positioned between, and in fluid communication with, the inner cylinder and the reservoir. At least one, one-way, spring-loaded ball-check-valve and the pressure release valve are disposed in the second interior passage. The base further has at least one, third interior passage positioned between, and in fluid communication with, the inner cylinder and the reservoir. At least one, one-way, spring-loaded ball-check-valve is disposed in the third interior passage. These interior passages provide fluid communication between the inner cylinder and outer reservoir for raising and lowering the lift assembly.

These and other objects of the present invention will become apparent from a reading of the following specification, taken in conjunction with the enclosed drawings.

BRIEF DESCRIPTION OF THE DRAWINGS

FIG. 9 is a bottom plan view of the jack of FIG. 1, shown in its fully collapsed position.

FIG. 10 is a rear elevational view of the jack of FIG. 1, shown in its fully collapsed position.

FIG. 11 is a front elevational view of the jack of FIG. 1, shown in its fully collapsed position.

FIG. 12 is a side view, in cross-section, illustrating the means of coupling the two members of the handle means in the preferred embodiment.

DESCRIPTION OF THE PREFERRED EMBODIMENT

Figure 1:
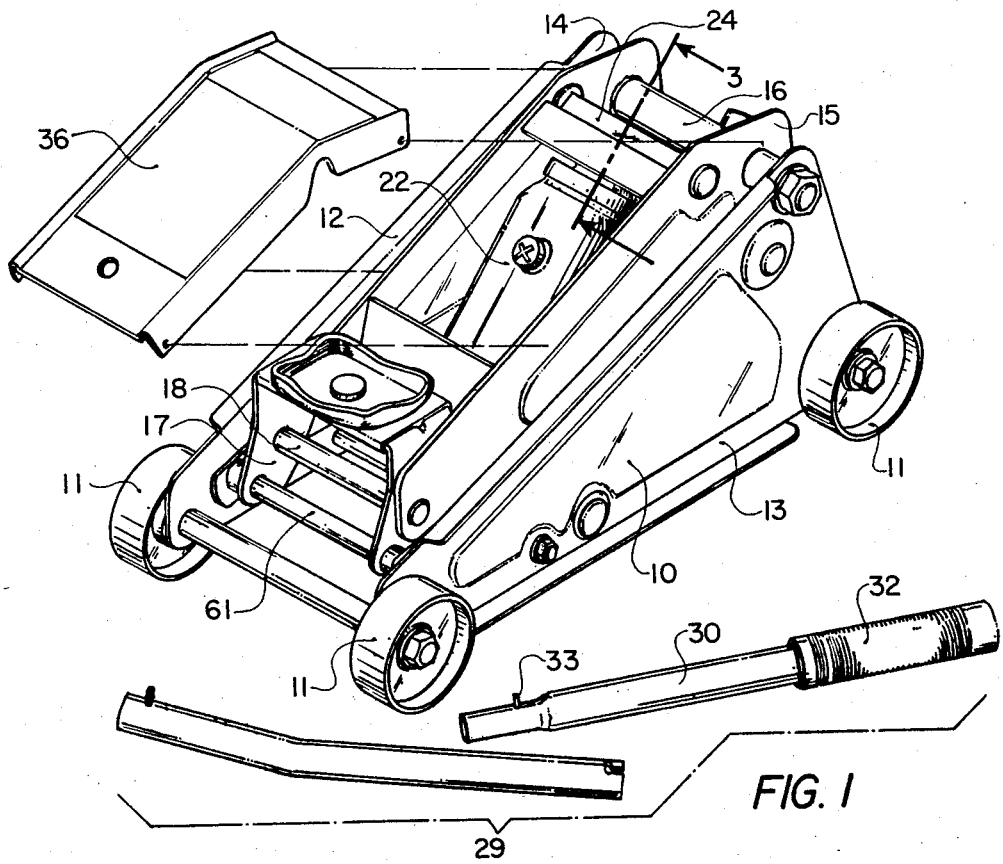
FIG. 1 is a perspective view of the preferred embodiment of the hydraulic four-wheel jack of the present invention illustrated in its collapsed position, with its dust cover removed for the sake of clarity, and showing the preferred embodiment of the handle means of the instant invention.
Figure 2:
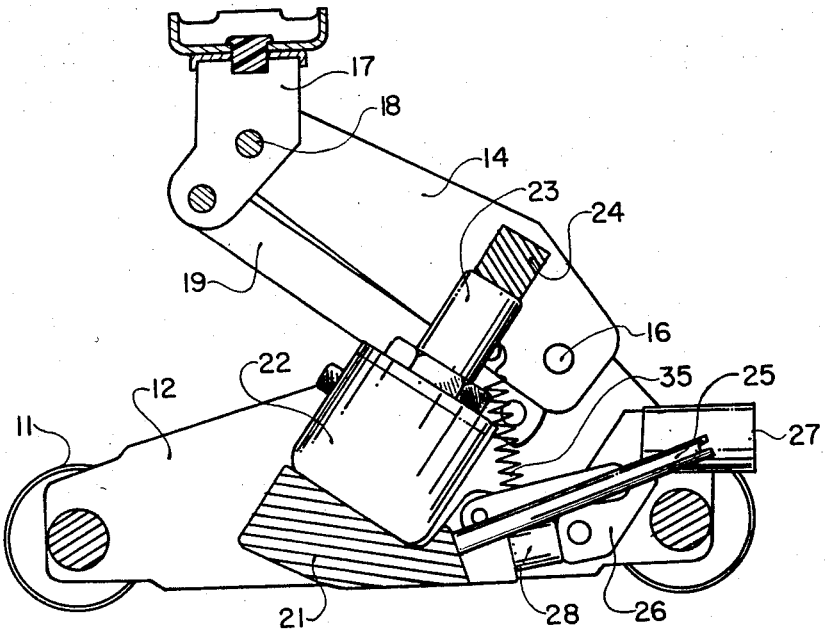
FIG. 2 is a side elevation, in partial cross-section, of the jack of FIG. 1 in its fully raised, lifting position.

With reference to FIGS. 1 and 2, there is a hydraulically operated lifting jack 10 of the type having a wheeled carriage including wheels 11, a pair of substantially parallel side plates 12 and 13 and a pair of elongated cantiliver arms 14 and 15. One end of each of the cantiliver arms 14 and 15 is pivotably mounted on a shaft 16 between the side plates 12 and 13 near one end of the carriage. The other, respective free ends of the cantilever arms 14 and 15 pivotably carry the lift assembly 17 on a second shaft 18.

A pair of elongated stabilizing struts 19 and 20 are positioned parallel with the cantilever arms 14 and 15. Each of the struts 19 and 20 is pivotably connected at their one end to the side plates 12 and 13. The other free ends are pivotably secured by a shaft 61 to the lift assembly 17.

A base 21 is rotatably positioned and secured between the side plates 12 and 13 intermediate the ends of the carriage. A hydraulic cylinder 22 is positioned above, and is integral with, the base 21. The cylinder 22 carries a piston 23 that bears against a cross-wise shaft 24 rotatably mounted between the cantilever arms 14 and 15.

A pressure release valve rod 25 is positioned within and projecting from the base 21, whereby pressure within the hydraulic cylinder 22 may be adjusted so that the jack may be raised or collapsed, as desired.

A reciprocating pump 28, with two ends, has its one end carried within the base 21. Its other end is pivotably mounted to one end of a bracket 26. The other end of the bracket 26 carries a socket 27 for operational contact threrwith, whereby rocking the socket 27 in an up and down motion actuates the piston 23 thereby extending the jack and lifting the article desired.

A return spring 35 is provided, one end of which is secured to a projection (not shown) of the side plate 12. The other end of the return spring 35 is established on a cantilever arm 14 whereby pull is provided to reset the cantilever arms 14 and 15 and struts 19 and 20 to the zero position.

A dust cover 36 is also provided, being positioned on the jack in the manner illustrated in FIG. 1, having been removed for clarity of understanding.

Now with reference to FIG. 12, in addition to FIG. 1, the handle, generally designated 29, has an upper member 30 and a lower member 31. The upper member 30 has a grip means 32 at its one end, and at its other, tapered end, a pin 33 projecting therefrom. The lower member 31 carries at its one end a pin 34. At its other end, is an "L" shaped indentation for receiving the pin 33 of the upper member 30. To couple the members, the tapered end of the upper member, is inserted into the lower member 31 so that the pin 33 is received in the indentation and turned for coupling, whereby a handle 29 is formed for insertion into the socket 27.

Figure 3:
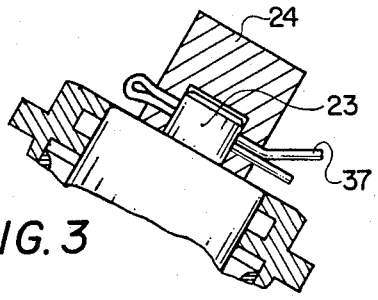
FIG. 3 is a cross-section, taken across the lines 3—3 of FIG. 1, drawn to an enlarged scale, and showing the connection between the piston and cross-wise shaft.

As illustrated in FIG. 3, the piston 23 is received within, and bears against an indentation on a face of the rotatably set cross-wise headed shaft 24 where it is secured in place by a cotter pin 37.

Figure 4:
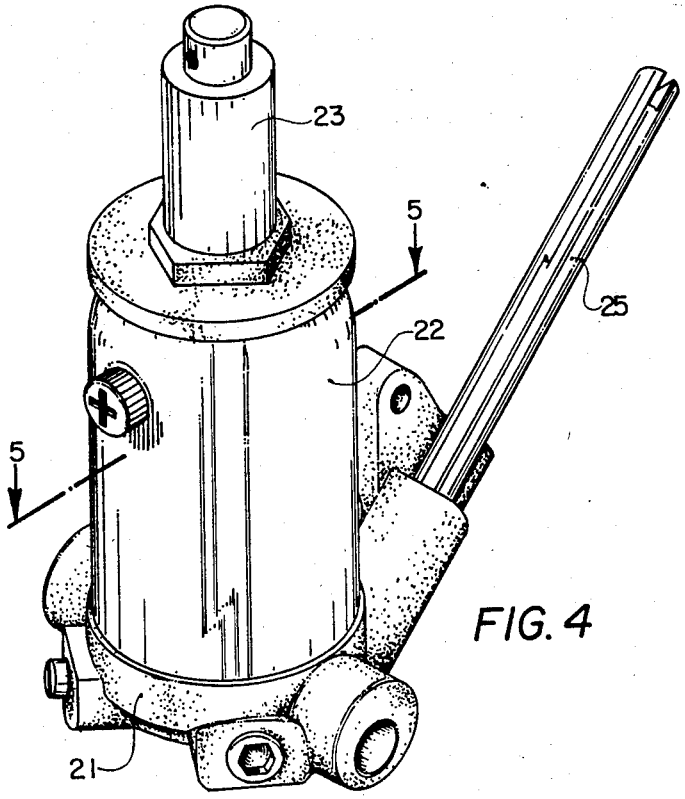
FIG. 4 is a perspective view of the hydraulic unit removed from the jack of FIG. 1 (with the reciprocating pump means removed for the sake of clarity).

With reference to FIG. 4, the hydraulic subassembly is provided with a pressure release valve rod 25. A base 21 is positioned beneath and integral with, a hydraulic cylinder 22 which carries a piston 23.

Figure 5:
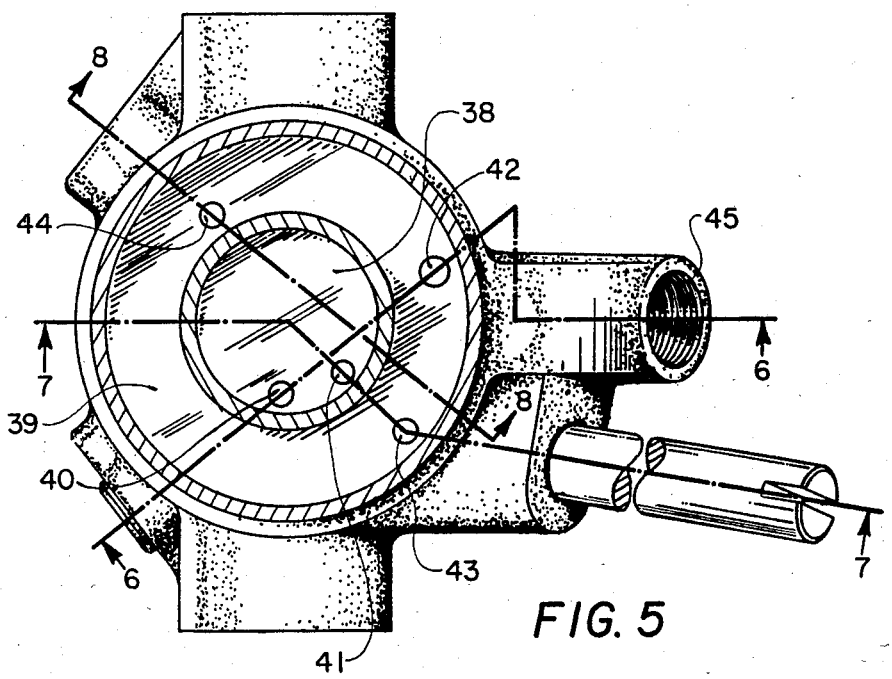
FIG. 5 is a cross-section, taken across the lines 5—5 of FIG. 4.

The hydraulic cylinder has an inner cylinder 38 and an outer annular oil supply reservoir 39 as illustrated in FIG. 5. The piston 23, removed for clarity of understanding, is carried by the inner cylinder 38. Openings in the inner cylinder 40 and 41 and in the reservoir 42, 43 and 44 are aligned with interior passages housed within the base for fluid communication therewith. The reciprocating pump 28 is inserted into an opening 45 in the base being provided for that purpose.

Figure 6:
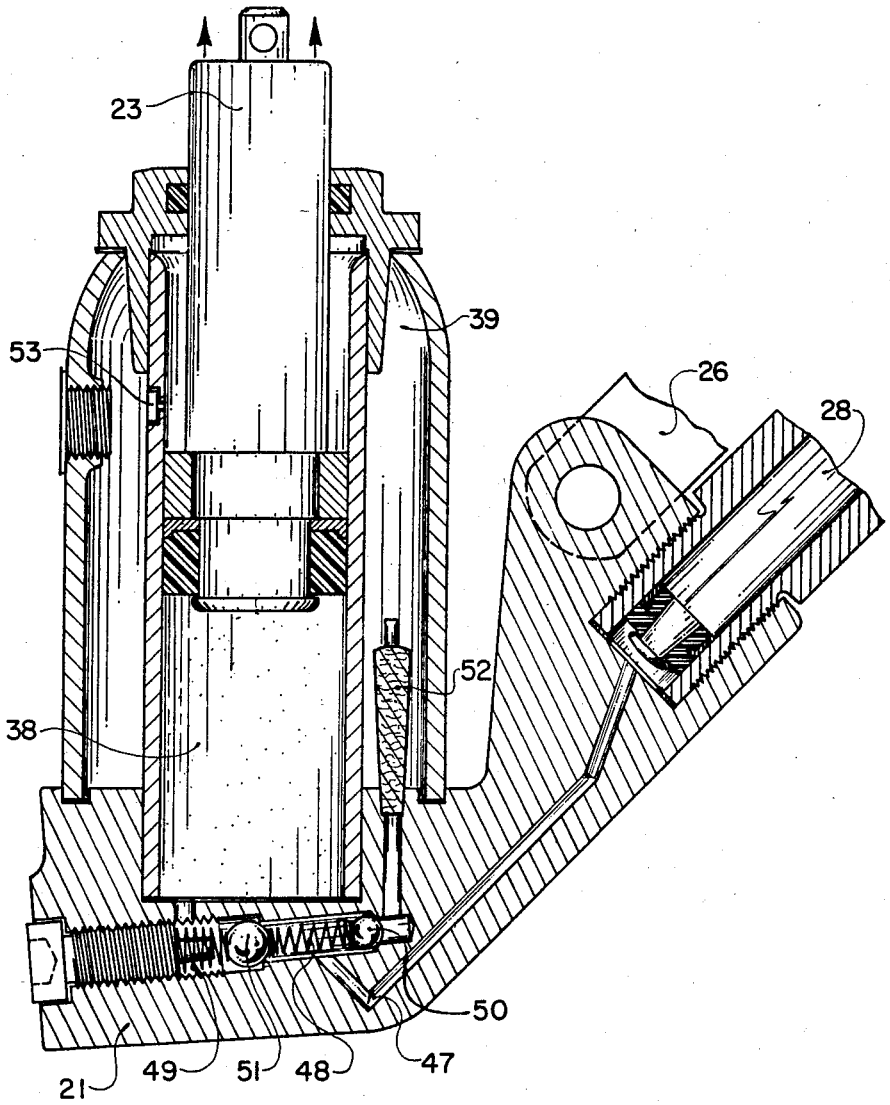
FIG. 6 is a stepped section taken across the lines 6—6 of FIG. 5.
Figure 8:
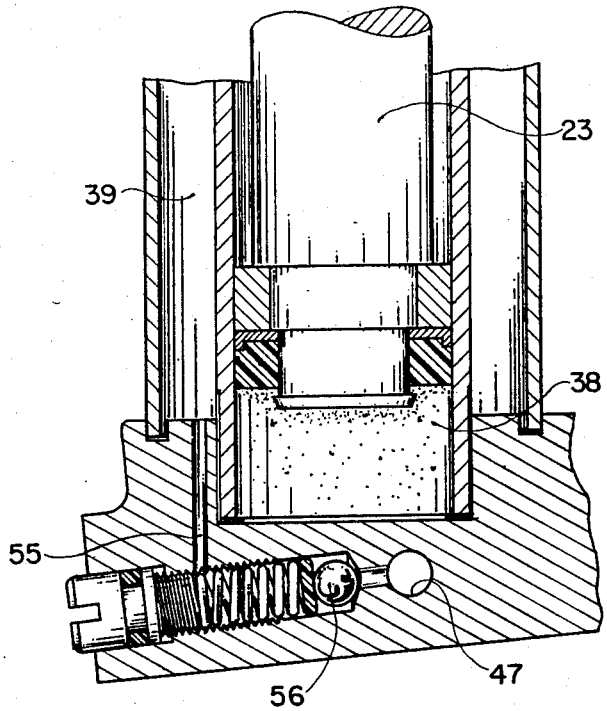
FIG. 8 is a further sectional view taken across the lines 8—8 of FIG. 5.
Figure 7:
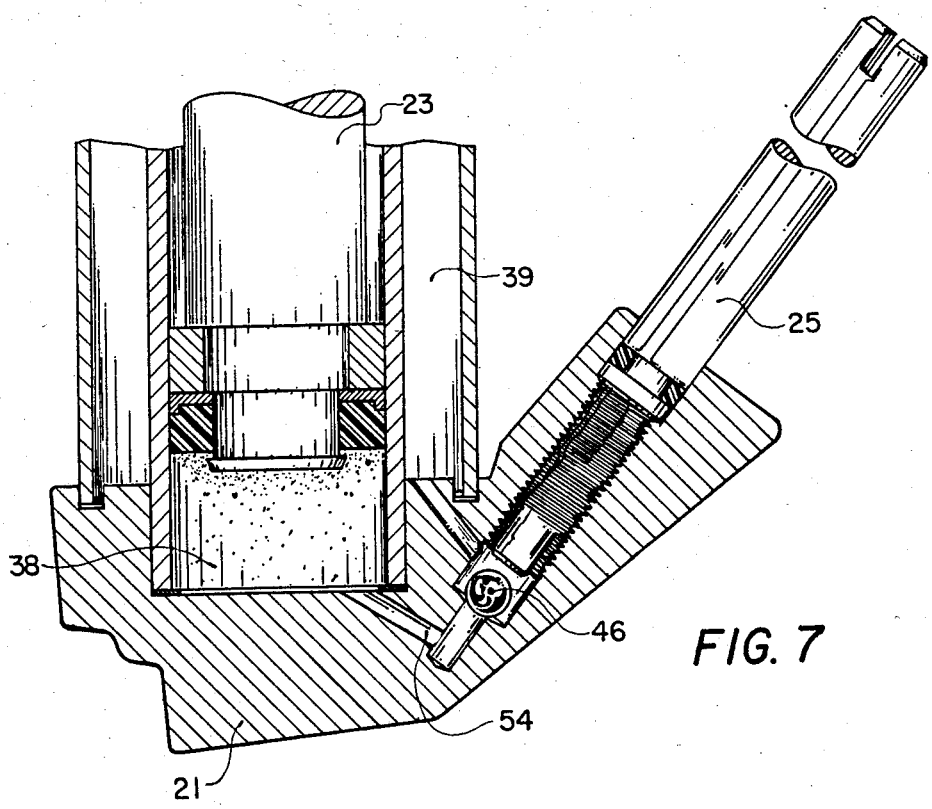
FIG. 7 is a further sectional view taken across the lines 7—7 of FIG. 5.

With reference to FIGS. 6, 7 and 8, the base 21 is provided with a series of interior passages for fluid communication between the inner cylinder 38, the reservoir 39, the reciprocating pump 28 and the pressure release valve 46 to provide the hydraulics for raising and lowering of the lift assembly.

With reference to FIG. 6, a first interior passage 47 is provided for lifting the piston 23 in the direction indicated by the arrows. This passage is provided with two oil holds 48 and 49, each housing a one-way, spring-loaded ball-check-valve 50 and 51. To raise the lift assembly, one first turns the pressure release valve rod 25 in a clockwise direction, thereby placing the pressure release valve 46 in a closed position (see FIG. 7) whereby oil pressure in the inner cylinder 38 is maintained. Then the handle 29, carried by the socket 27, is rocked in an upwardly direction, drawing the pump 28 outwardly from the base 21 whereby the first ball-check-valve 50 is unseated, and oil in the reservoir 39 is drawn by vacuum through a filter 52, the opening 42 and into the first passage 47, filling the first passage 47, including the oil hold 48, to occupy all the space that the pump 28 has emptied. When the pump 28 is inwardly pushed by a downwards rocking motion on the handle 29, the first valve 50 is forced back into its seated position (as seen in FIG. 6) preventing oil flow back into the reservoir and the second valve 51 is unseated allowing oil to flow through the second oil hold 49 of the first passage 47, and the second opening 40, respectively, and into the inner cylinder 38. The oil filling the inner cylinder 38 forces the piston 23 upwardly in the direction of the arrow, thereby raising the lift assembly 17 so that the desired object may be lifted.

With further reference to FIG. 6 there is also presented a bypass hole 53 in the wall between the inner cylinder 38 and the reservoir 39. This bypass hole 53 is provided to prevent damage from occurring to the device in the event of overpumping of oil into the inner cylinder 38. As oil is forced into the inner cylinder 38 there is a relative upward movement of the entire assembly, including the cross-wise headed shaft 24. This movement is due to the action of the piston 23 moving in the direction of the arrow which causes the cantilever arms 14 and 15 to raise the load carried by the lift assembly 17. This movement continues until a point is reached where the bypass hole 53 comes into registry with the fluid level in the inner cylinder 38. At that point, the continued operation of the reciprocating pump 28 merely forces additional oil from the inner cylinder 38 through the bypass hole 53 and back into the reservoir 39. In this manner, no further lifting can take place, thus there is no chance of the piston 23 being forced completely out of the cylinder 22. Furthermore, there is no excessive buildup of pressure which might cause the device to break down, because any further attempt to pump fluid into the cylinder 38 merely causes it to flow directly back into the reservoir 39 through the bypass hole 53.

Referring now to FIG. 7, the base 21 is provided with a second, interior passage 54 which houses the pressure release valve 46. This second passage 54 is in fluid communication with the inner cylinder 38 and the reservoir 39 whereby, when the valve 46 is unseated, lowering of the piston 23 may be effected so that the device can be collapsed for storage, etc. The valve 46 is a ball-check-valve. It is unseated by turning the pressure release valve rod 25 in a counter-clockwise direction and manually applying force downwardly on the piston 23. This motion forces oil out of the inner cylinder through the third opening 41, the second passage 54, and the fourth opening 43, respectively and into the outer reservoir 39, so that the device may be collapsed.

Referring now to FIG. 8, a third interior passage 55 is provided, being positioned in fluid communication with the first passage 47 and the outer reservoir 39 to protect the jack at times when the jack is subjected to a load greater than its designed capacity. This third passage 55 houses a third, one-way spring-loaded ball check-valve 56. In a preferred embodiment, the spring of this valve 56 is of a heavier gauge than the spring of the other spring-loaded ball-check valves 50 and 51. This valve 56 *only* permits oil flow *into* the outer reservoir 39.

At times when an overload occurs, oil drawn into the first passage 47 by the reciprocating pump 28 cannot, due to the pressure of the oil already present in the inner cylinder 38, unseat the second valve 51, (see FIG. 6) in order to proceed into the second oil hold 49. Instead, the oil is forced from the first passage 47 into the third passage 55. There it unseats the third valve 56 and flows through the passage 55 and fifth opening 44, respectively and into the reservoir 39.

With reference to FIG. 9, the cantilever arms 14 and 15 and the stabilizing struts 19 and 20 are connected at their respective one end to the lift assembly 17. The base 21 is seen carrying the pressure release valve rod 25 and the reciprocating pump 28. The socket 27 is also shown with a handle 29 inserted therein.

In FIG. 10, the structure of the socket 27 is best illustrated. The socket 27 has an "L" shaped indentation into which a pin 34, positioned on the exterior of the lower member 31 of the handle, is inserted and turned, whereby the handle is coupled to the socket 27 for operational contact therewith.

In FIG. 11, the lift assembly 17 can be seen being positioned on a plane located substantially lower than that of the cross-wise shaft 24 when the device is in its fully collapsed position.

Figure 13:
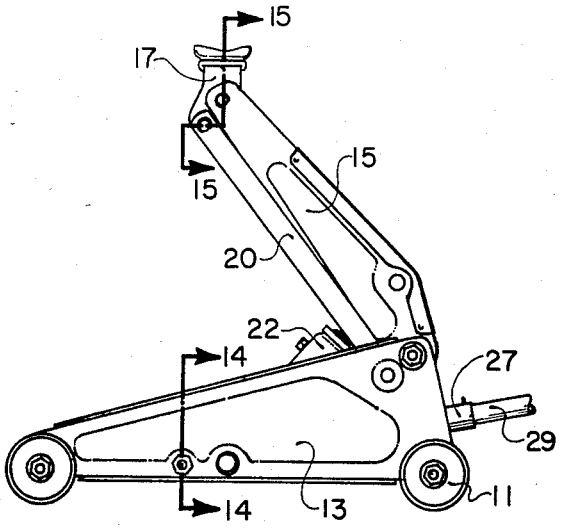
FIG. 13 is a side view of the jack of FIG. 1, shown in its fully extended, lifting position.

In FIG. 13 is the jack in its fully extended position. In that position the cantilever arms 14 and 15 and their parallel struts 19 and 20 extend above the side plates 12 and 13 with the lift assembly 17 positioned on the raised end.

Figure 14:
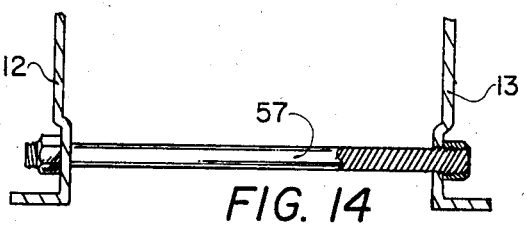
FIG. 14 is a frontal view, in partial cross-section, of a lower bracing member of the preferred embodiment, taken across the line 14—14 FIG. 13.

Lower bracing members 57 are positioned between the side plates 12 and 13 and mounted thereto as shown in FIG. 14, whereby additional support for the carriage is provided.

Figure 15:
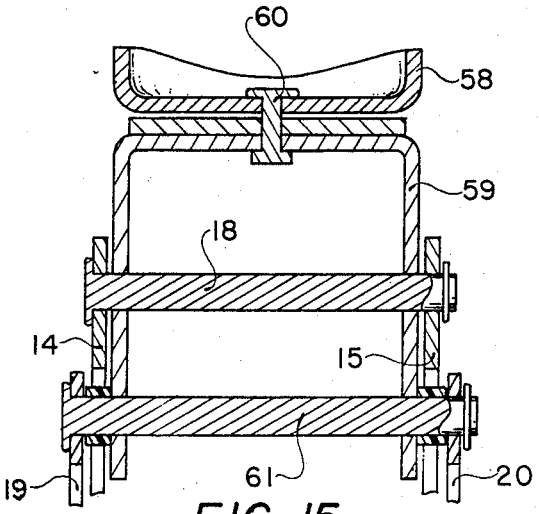
FIG. 15 is a frontal view, in cross-section, of the lift assembly taken across the line 15—15 of FIG. 13.

As seen in FIG. 15, the lift assembly 17 has a lift saddle 58 mounted to a lift base 59 for rotational movement thereon by means of an "I" pin 60. The lift base 59 is positioned between the cantilever arms 14 and 15 and stabilizing struts 19 and 20. The base is pivotably mounted thereto by a pair of shafts 61 and 18, whereby raising of the cantilever arms and the struts raises the lift assembly 17. It will be appreciated by those skilled in the art that this lift assembly could be of any suitable design or material consonant with the teachings of this invention.

Figure 16:
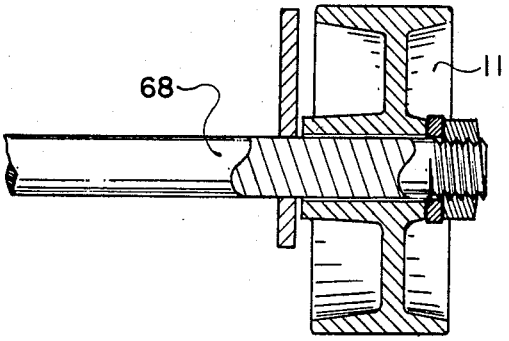
FIG. 16 is a frontal view, in partial cross-section, taken across the line 16—16 of FIG. 13.

With reference to FIG. 16, each of the wheels 11 is provided with an aperture through its center. This aperture is aligned with a corresponding aperture in each of the side plates. These apertures carry a bolt axle 62 which is secured to the jack by nuts, whereby wheels 11 for the carriage are provided.

Obviously, many modifications may be made without departing from the basic spirit of the present invention. Accordingly, it will be appreciated by those skilled in the art, that within the scope of the appended claims, the invention may be practiced other than has been specifically described herein.

What we claim is:

1. In a hydraulically operated lifting device of the type having a wheeled carriage including a pair of substantially parallel side plates, a pair of elongated cantilever arms extending above the side plates and having a pair of respective end portions, means for pivotably mounting one end portion of each of the arms between the side plates near one end of the carriage, a lift means on the other free end of the arms, a pair of elongated stabilizing struts parallel with the cantilever arms and pivotable connected between the side plates and the lift means, the improvement comprising, in combination, a hydraulic cylinder pivotably mounted between the plates intermediate the ends of the carriage, a piston within the cylinder and operatively associated therewith, a shaft substantially rectangular in cross-section and having a plurality of flat faces, and the shaft being pivotably mounted crosswise on the cantilever arm intermediate the end portions thereof, wherein the piston extends in a substantially upwards direction engaging one of the flat faces on the shaft whereby the cantilever arms, struts and lift means are raised.

2. In a hydraulically operated lifting device having a first extended position and a second collapsed position, of the type having a four wheeled carriage including a pair of substantially parallel side plates, a pair of elongated cantilever arms extending above the side plates, and having a pair of respective end portions, a means for pivotally mounting one end portion of each of the arms between the side plates near one end of the carriage, a lift means on the other free end of the arms, a pair of elongated stabilizing struts parallel with the cantilever arms and pivotably connected between the side plates and the lift means, the improvement comprising, in combination, a hydraulic actuator having an outer annular oil supply reservoir and an inner cylinder and being pivotably positioned between the side plates intermediate the ends of the carriage, a piston being positioned within the inner cylinder and operatively associated therewith, a shaft substantially rectangular in cross-section, having a plurality of flat faces and being pivotably mounted cross-wise on the cantilever arms intermediate the end portions thereof whereby the piston extends in a substantially upwardly direction engaging one of the flat faces of the shaft, hydraulic fluid being positioned in the outer reservoir, a reciprocating pump means for drawing hydraulic fluid from the reservoir and for forcing hydraulic fluid into the inner cylinder, a pressure release valve having a first closed position whereby oil pressure in the inner cylinder is maintained, and further having a second open position whereby hydraulic fluid is allowed to flow from the inner cylinder, a base pivotably mounted between the side plates intermediate the ends of the carriage and positioned beneath the hydraulic cylinder and secured thereto, said base having at least one first interior passage being provided with at least two, one-way, spring-loaded ball-check-valves and being positioned between and in fluid communication with the reservoir, the reciprocating pump means and the inner cylinder, at least one second interior passage being provided with at least one, one-way, spring-loaded ball-check-valve and the pressure release valve, said second passage being positioned between, and in fluid communication with, the inner cylinder and the reservoir, said base further having at least one, third interior passage being provided with at least one, one-way, spring-loaded ball-check-valve and being positioned between and in fluid communication with the inner cylinder and the first interior passage whereby the interior passages provide fluid communication between the inner cylinder and outer reservoir for raising and lowering of the lift means.

3. The device of claim 2 wherein the one-way, spring-loaded ball-check-valve, positioned in the third interior passage, is provided with a spring being of a substantially heavier gauge than the other remaining one-way, spring-loaded ball-check-valves.

* * * * *